US008950013B2

(12) United States Patent
Bates

(10) Patent No.: US 8,950,013 B2
(45) Date of Patent: Feb. 10, 2015

(54) GRIP GARMENT

(76) Inventor: Robert Bates, Howell, MI (US)

( * ) Notice: Subject to any disclaimer, the term of this patent is extended or adjusted under 35 U.S.C. 154(b) by 318 days.

(21) Appl. No.: 12/381,393

(22) Filed: Mar. 10, 2009

(65) Prior Publication Data

US 2010/0229278 A1 Sep. 16, 2010

(51) Int. Cl.

*A41B 1/00* (2006.01)
*A41D 13/00* (2006.01)
*A41D 13/05* (2006.01)

(52) U.S. Cl.

CPC ..... *A41D 13/0002* (2013.01); *A41D 13/05* (2013.01); *A41D 2400/80* (2013.01); *A41D 2600/20* (2013.01)
USPC ..... 2/115

(58) Field of Classification Search

USPC ..... 2/102, 115, 121, 122
See application file for complete search history.

(56) References Cited

U.S. PATENT DOCUMENTS

| | | | | |
|---|---|---|---|---|
| 5,201,074 | A * | 4/1993 | Dicker | 2/70 |
| 5,611,084 | A * | 3/1997 | Garry et al. | 2/93 |
| 6,195,802 | B1 * | 3/2001 | Armellino | 2/102 |
| 7,191,470 | B2 * | 3/2007 | Benini | 2/69 |
| 7,322,050 | B2 * | 1/2008 | Heatherly | 2/244 |
| 2008/0256691 | A1 * | 10/2008 | White et al. | 2/455 |

* cited by examiner

*Primary Examiner* — Amber Anderson
(74) *Attorney, Agent, or Firm* — Mitchell M Musial, PLLC

(57) ABSTRACT

Disclosed herein is a grip garment for assisting a user in carrying an item. The garment comprises an article of clothing selected from a long sleeve shirt, a short sleeve shirt and a vest. The article has at least one lateral grip area having a frictional material, such as an elastomer, applied to the lateral grip area to create a frictional surface extending above the outside surface of the article. The frictional surface is in contact with an item carried under the arm of a user to resist the relative motion of the item with respect to the grip area. Additional grip areas are also disclosed.

12 Claims, 4 Drawing Sheets

GRIP GARMENT

FIELD OF THE INVENTION

The present invention relates to a garment to assist warehouse or shipping workers in carrying items. More specifically, the present invention relates to a garment providing grip assisting to workers carrying items.

BACKGROUND OF THE INVENTION

It is well known to use clothing such as gloves to assist humans in gripping an object. Examples include the gloves worn by professional athletes for gripping a bat, golf club or football. Additionally, gloves formed of rubber or other polymers are useful to improve grip in wet conditions. Other examples of grip garments are cloth gloves having rubber "dots" molded into the cloth. A user of such a garment includes an auto mechanic who wears gloves to protect their hands from the cold or injury. However, without the rubber dots, the user would lose their grip because cloth has a lower coefficient of friction than skin. These "rubberized" products have been typically limited to gloves and footwear. It would be useful to provide a garment that could be used to assist dock or warehouse workers in carrying items, such as boxes, containers, packages and the like.

A warehouse or shipping worker will generally try to carry as many items as possible, for instance, by carrying multiple items under their arms, or larger, clumsier items against their chest. By using, in part, friction between the surface of the workers clothing and the items, the load burden would be shared by other body parts other than their hands and arms to carry items. Additionally, slipping could be reduced as well. It would be an advantage to provide work clothing that could assist a worker with their grip.

One such example of grip style clothing is found in U.S. Pat. No. 5,822,794, which discloses a gripping football shirt comprised of lycra, cotton, nylon, polypropylene or spandex blends with neoprene strips mounted on the inside of the anatomical arms. The neoprene strips are provided to give a player a non-slip grip upon the football during retrieving and possession. The shirt also allows for increased protection against skin abrasions while playing on natural and artificial surfaces. Although the invention of the '794 patent would be helpful, it does not provide a complete solution.

U.S. Pat. No. 7,117,537 discloses a riding suit, in particular for motor-cyclists, where the correspondence of parts of the body of the wearer under use conditions are in touch with or, at least, graze parts of the motor-cycle, on the outer surface thereof there are provided zones that are fabricated with slip-resistant materials. Although the invention disclosed in '537 patent seems to be a good solution for riding a motorcycle, it is not suited for freight or dock workers who have to optimize the number of packages they carry.

U.S. Pat. No. 5,791,538 discloses a pad for frictionally supporting an automotive transparency carried by an individual has bead or ridges made of friction material and is detachably secured to the belt of the individual extending over a portion of the individual's thigh. The windshield is urged against the friction material to assist in maintaining the windshield above the floor as it is moved. The pad has loop portion of a hook and loop securing arrangement with the hook portion secured to the belt. To prevent downward movement of the belt, ends of suspenders are provided with loop portions of the securing arrangement for detachably securing the suspenders to the belt to assist in maintaining the belt in position about the waist of the individual. While the '538 patent provides a very good solution to a specific problem, it does not solve the problems faced by a dock or freight worker, that it, it does not assist the worker in carrying items under their arms or on their chest/abdomen.

U.S. Pat. No. 7,191,470 discloses a torso-covering garment for playing paintball having gripping areas to enable the user to grippably contact a gripping area of the garment with the butt stock of the gun. Each gripping area comprises a pliant, non-cushioning substrate. Common embodiments of the garment are shirts, jerseys, jackets, and vests. Again, the disclosure of U.S. Pat. No. 7,191,470 reveals a specific application for shooting a paint ball gun, rather than a device for assisting a user in carrying items.

Thus, there is a need in the art to provide a garment for assisting a user in caring items, such as boxes, packages, containers and the like. Further it would be desirable to provide a garment for assisting a user in carrying an item under their arm. And finally, it is desirable to provide a garment that is designed to provide such assistance without stretching or deforming.

SUMMARY OF THE INVENTION

A grip garment for assisting a user in carrying an item comprises an article of clothing adapted to be worn on the torso of the user, where the article comprises a flexible material having an inside surface and outside surface. The article has at least one lateral grip area. A friction material is applied to the lateral grip area to form a frictional surface extending above the outside surface of the article. The frictional surface is in contact with an item carried under the arm of the user to resist the relative motion of the item with respect to the grip area. In one embodiment, the grip area may have frictional material applied in a spaced pattern, such as a polka dot pattern.

In one embodiment, the article is selected from the group consisting of a vest, a short sleeve shirt, and a long sleeve shirt. It is preferred that the grip garment article have a frictional surface on a right lateral grip area and a left lateral grip area. The garment may include a reinforcing material operatively attached to the flexible material. The reinforcing material covers the lateral grip area and extends around at least one of the user's shoulders to distribute a load to the shoulder and resist deformation of the flexible material.

The grip garment may also include a support belt fixedly attached to a lower torso area of the article. The belt includes a relatively wide back portion and two relatively narrow straps extending from first and second ends of the back portion, said belt having fastening means for coupling said straps at distal ends.

An alternate embodiment of a grip garment for assisting a user in carrying an item comprises a long sleeve shirt having a torso section and two arm sections, where the shirt comprises a flexible material having an inside surface and outside surface. The torso section has a right lateral grip area and a left lateral grip area. A friction material is applied to each lateral grip area to form a frictional surface extending above the outside surface of the shirt. The frictional surface is in contact with an item carried under the arm of the user to resist the relative motion of the item. In one embodiment, the grip area may have frictional material applied in a spaced pattern, such as a polka dot pattern.

In one embodiment, the shirt has a friction material applied to a right brachial grip area and a left brachial grip area to form right and left brachial frictional surfaces for further resisting the relative motion of an item. Additionally, friction material may be applied to an anterior grip area to form an anterior frictional surface, where the anterior frictional surface is in contact with an item held against the abdomen of a user to resist the relative motion of the item.

Reinforcing material may be operatively attached to the shirt, covering at least one lateral grip area and extending around at least one of the user's shoulders to distribute a load to the shoulder and resist deformation of the shirt. The reinforcing material may have a vest-like pattern extending around both of the user's shoulders to distribute a load to the shoulders and resist deformation of said shirt. The reinforcing material may have a vest-like pattern extending around both of the user's shoulders to distribute a load to the shoulders and resist deformation of the shirt.

The grip garment of the present embodiment may also include a support belt fixedly attached to a lower torso area of the article. The belt includes a relatively wide back portion and two relatively narrow straps extending from first and second ends of the back portion, said belt having fastening means for coupling said straps at distal ends.

In still another alternate embodiment of a grip garment for assisting a user in carrying an item comprises a vest having a torso section, where the vest comprises a flexible material having an inside surface and outside surface. The torso section has a right lateral grip area and a left lateral grip area. A friction material is applied to each of the lateral grip areas to form a frictional surface extending above the outside surface of the vest. The frictional surface is in contact with an item carried under the arm of the user to resist the relative motion of the item. The grip garment may further comprise selectively detachable right and left arm sections. The right arm section has a right brachial grip area and left arm section has a left brachial grip area, where the arm sections have friction material applied to the right brachial grip area and the left brachial grip area to form right and left brachial frictional surfaces for further resisting the relative motion of the item.

The vest has a friction material applied to an anterior grip area to form an anterior frictional surface, where the anterior frictional surface is in contact with an item held against the abdomen of a user to resist the relative motion of the item.

Further objects, features and advantages of the present invention will become apparent to those skilled in the art from analysis of the following written description, the accompanying drawings and the appended claims.

DESCRIPTION OF THE PREFERRED EMBODIMENT

Figure 1:
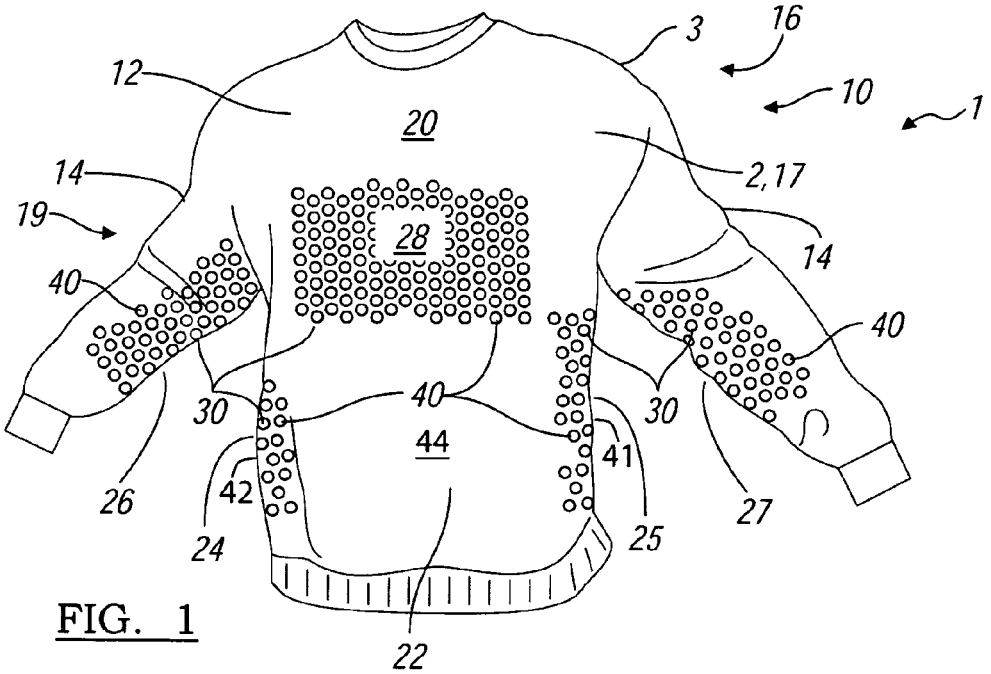
FIG. 1 is a front view of a grip garment according to the principles of the present invention revealing an article of clothing comprising a long sleeve shirt.

The wearable garment of the present invention shall be described as is employed on the torso of a user in three dimensions so as to clearly illustrate the novelty of the present invention. Accordingly, the wearable garment is described as having a front, back, right side, and left side as it would when being worn by a user. Although the terms used to describe the present invention may be the same or similar to those used to refer to the human anatomy, the present invention is described with respect to the garment wearable by a user for assisting a user in carrying an item. With initial reference to FIG. 1, a front view of a grip garment 10 comprising an article of clothing 12 will be defined in terms with respect to a sagittal plane and a coronal plane as commonly used to describe the human anatomy. The sagittal plane is the longitudinal plane that divides the human body into right and left sections and the coronal plane is also a longitudinal plane that is at a right angle to the sagittal plane and divides the human body into anterior and posterior portions. The article of clothing 12 is adapted to be worn on the torso 2 of the user 1 and at least partially covers the shoulders 3 of the user 1. As used herein, torso shall refer to the portion of the human body not including the head and limbs. According to the principles of the present invention, article 12 is selected from the group consisting of a vest, a short sleeve shirt and a long sleeve shirt. Additionally, the article 12 may include a hooded sweatshirt and a zip-up sweatshirt. In the exemplary embodiment of FIG. 1, the article 12 is a long sleeve shirt 16. The long sleeve shirt 16 includes a torso area 17 and a pair of sleeves 14 substantially covering the user's arms 19. The article 12 comprises a flexible material 20, including, but not limited to, cotton, polyester, a cotton polyester blend, nylon, wool, linen, silk, spandex, hemp, various brands of para-aramid synthetic fiber, and polyethylene fiber.

The flexible material 20 has an inside surface (not shown) facing toward the body of the user 1 and outside surface 22 facing away from the user 1. The long sleeve shirt 16 of FIG. 1 includes right and left lateral grip areas 24, 25, right and left brachial grip areas 26, 27 and an abdominal grip area 28. A friction material 30 is applied to each of said grip areas 24-28 to form a frictional surface 40 extending above the outside surface 22 of the article 12. In the preferred embodiment, the friction surface 40 is formed by screen printing plastisol on the flexible material 20 so that frictional material 30 at least partially extends above the outside surface 22 of the article 12. Although plastisol is the preferred material 30, other materials may be substituted for plastisol within the spirit and scope of the present invention, including, but is not limited to, combinations, mixtures and compositions of elastomers, or other polymers, such as latex, vinyl, nitrile, silicone, polyurethane, polypropylene, PVC and polyethylene.

The best mode of making the present invention is achieved by applying the friction material 30 to the flexible material 20 by a three dimensional screen printing process, although any suitable method known in the art may be substituted for three dimensional screen printing, including dip coating, casting, spraying and spread coating. Additionally, the friction material may be deposited on a substrate other than the flexible material 20, such as a reinforcing material, as disclosed further herein.

The friction material 30 is applied to the lateral grip areas 24, 25 to form a frictional surface 40 extending above the outside surface 22 of said article 12. The frictional surface 40 is in contact with an item carried under the arm of a user 1 to resist the relative motion of the item. The grip garment 10 assists a user 1 in carrying an item, such as a box, package, container and the like, as will be described further.

Figure 2:
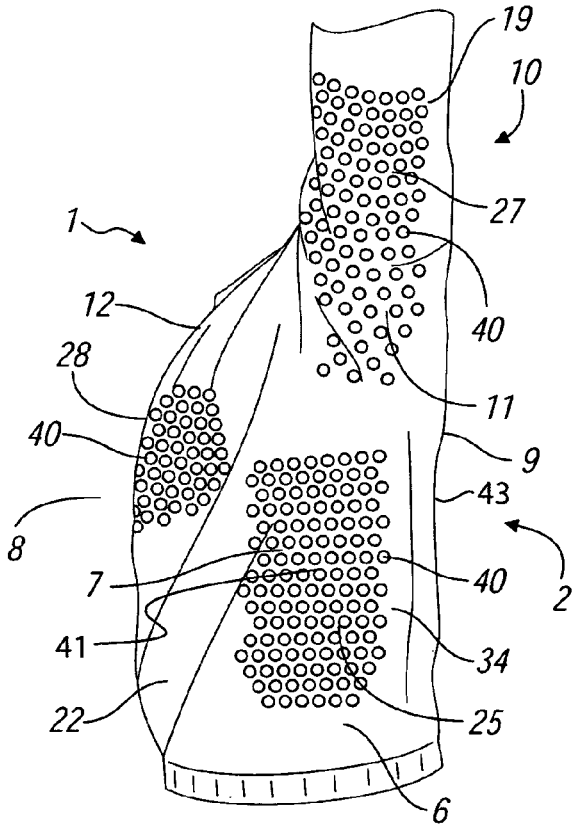
FIG. 2 is a lateral view of the grip garment of FIG. 1 according to the principles of the present invention.

Referring now also to FIG. 2, a lateral view of the grip garment 10 of FIG. 1 is shown, revealing a left lateral grip area 25 and left brachial grip area 27. According to the principles of the present invention, as few as one lateral grip area 25 may be provided to assist a user 1 in carrying an item (not shown). The torso 2 has a ventral side 8 and a dorsal side 9. The garment 10 has a left side 41, a right side 42, a back side 43 and a front side 44. The left side 41 and right side 42 are generally parallel to the sagittal plane of a torso 2 and the back side 43 and front side 44 are generally parallel to the coronal plane of the torso 2. The lateral grip areas 24, 25 are located on the right side 42 and left side 41 of the garment, respectively. A serratus anterior area 7 and external oblique area 6 are located on the sides 41, 42 of the garment. The serratus anterior area 7, external oblique area 6 and the lateral grip areas 24, 25 are generally parallel to the sagittal plane as well. The lateral grip areas 24, 25 are each bound by a serratus anterior area 7 and external oblique area 6, where the serratus anterior area 7 is superior to the external oblique area 6. The lateral grip areas 24, are generally disposed along the lateral side of the torso 2. As used herein, lateral grip areas 24, 25 shall correspond with the lateral side of the torso 2 and preferably not extend above serratus anterior area 7 and not extend below the external oblique area 6. Each of the lateral grip areas 24, 25 is disposed to provide a frictional surface 40 to be in contact with an item carried under the arm 19 of a user 1 to resist the relative motion of the item with respect to the grip area 24 or 25. Ideally, the frictional surface 40 is a slip resistant surface, which could be described as "rubbery".

Grip assistance of the garment 10 is achieved at least in part by the article 12 having at least one lateral grip area 25. It is common for people to carry packages in an under arm fashion, where a package is held against the person's side (lateral torso). As used herein, "carried under the arm" shall mean the act of a positioning an object between the lateral torso and arm whereby the object is held in place by adduction of the arm toward the lateral torso. However, the package will typically slide or "squirt out" because of the slick interface between the packaging materials used—cardboard, paper and plastic—and nylon, polyester and cotton materials found in clothes. The result is that more force is applied by the person's arms to keep the package in place, which leads to: 1) fatigue and 2) crushed packaging. The user 1 of the present invention is able to reduce the load burden on their arms 19 by holding an item, such as a box, against the grip area 25.

The friction material 30 that is applied to the lateral grip area 25 of the torso 2 provides an upward resistive force to counter at least in part, the downward gravitational force acting on the box. The upward resistive force works to prevent the box from slipping downward. A reaction force to the resistive force pulls downward on the garment 10 of the present invention. Therefore, part of the load of the item, in this example a box, is translated through the shirt 16 and is carried by the torso 2. The advantage is clear in that some of the load burden that would have been on the user's arm 19 is applied to the user's torso 2. Accordingly, relief from fatigue is clearly and advantage of the garment 10 of the present invention.

In addition to reduced load on the user's arm 19, the garment 10 of the present invention prevents an item from slipping and being dropped and damaged. Additionally, by reducing slipping and dropping, worker efficiency is also increased. The addition of the friction material 30 to the lateral grip area 25 provides an increased frictional force that resists the item from slipping out from between their torso 2 and arm 19. A user 1 will carry the item by adducting their arm 19 toward the lateral area of the torso 2 to hold the item against the lateral grip area 25. However, the garment 10 of the present invention requires less adduction force by the user 1 when carrying the item under their arm 19. As an example, the coefficient of friction is higher between the friction material 30 and cardboard than between cotton and cardboard. For example, conveyor systems for moving cardboard boxes have used nitrile on the contact surface of conveyor belts because of the high coefficient of friction between cardboard and nitrile. By the addition of friction material 30, less force is required to provide the same resistive force needed to prevent the item being carried from slipping, reducing fatigue and damage and increasing efficiency.

Additional grip assistance is provided by the right and left brachial grip areas 26, 27. As may be seen in FIG. 2, the left brachial grip area 27 extends roughly along the length of the arm 19 from the left axillary 11. The addition of the brachial grip areas 26, 27 provide more slip resistance to a user carrying items. An anterior grip area 28 is provided on the shirt 16. Friction material 30 is applied to the anterior grip area 28 to contact an item held against the ventral 8 portion of the torso 2 of a user 1 to resist the relative motion of the item.

In the preferred embodiment, the grip areas 24-28 have frictional material 30 applied in a spaced pattern 32 where the friction material 30 is deposited as discretely spaced areas. An advantage to a spaced pattern is breathability of the flexible material 20. The grip garment 10 illustrated herein has frictional material 30 applied in a "polka dot" pattern 34. Although a polka dot pattern is disclosed, it should be understood that a variety of friction material patterns may be employed, from a solid layer, to waves, bumps, and cross hatching to name a few. The friction material 30 may be black, clear or any color. Furthermore, it is contemplated to be within the spirit and scope of the present invention to have a reflective material applied on top of or integrated into the friction material 30. The safety aspects of having reflective material on a work shirt would be apparent to those skilled in the art. Additionally, a color pattern such as a logo or message may be designed into the frictional material 30, such as by forming an image by a pattern of colored dots.

Figure 3:
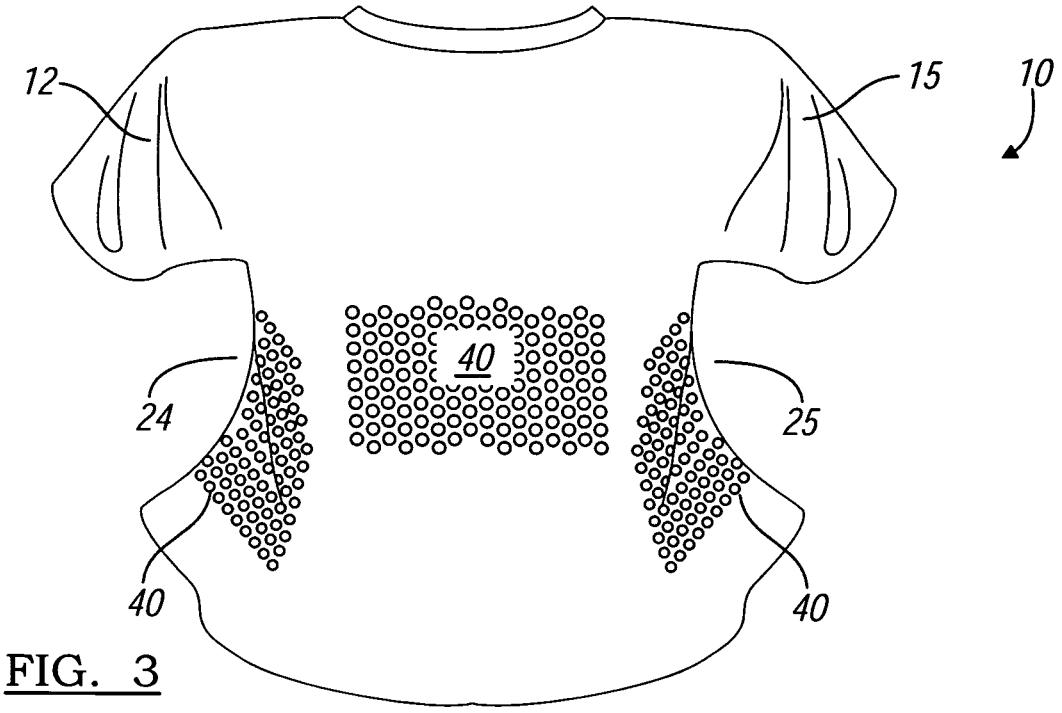
FIG. 3 is a front view of an alternative embodiment of a grip garment according to the principles of the present invention, where the article is a short sleeve shirt.

Referring now to FIG. 3, a front view of an alternative embodiment of a grip garment 10 according to the principles of the present invention is shown, where the article 12 is a short sleeve shirt 15. The shirt 15 has lateral grip areas 24 and 25. Accordingly, it is within the spirit and scope to adapt the present invention to any type of article worn on the torso 2. Additionally, the present invention may be utilized by non-dock workers as well, such as shoppers who want more carrying capability.

Figure 4:
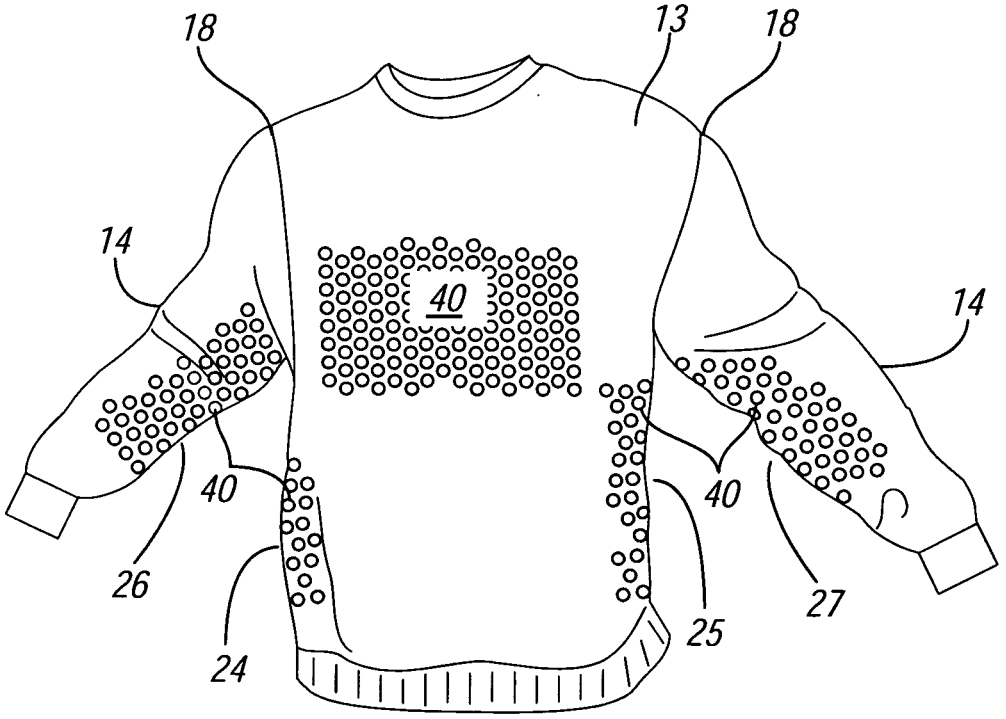
FIG. 4 is a front view of an alternative embodiment of a grip garment according to the principles of the present invention, where the article is a vest having attachable sleeves.

Referring now to FIG. 4, a front view of an alternative embodiment of a grip garment 10 according to the principles of the present invention is shown, where the article is a vest 13 having selectively attachable sleeves 14. The sleeves may be attached by a zipper 18 as shown, or they may be attached by any other suitable means known in the art, including, but not limited to snaps and hook and loop type fasteners.

Figure 5:
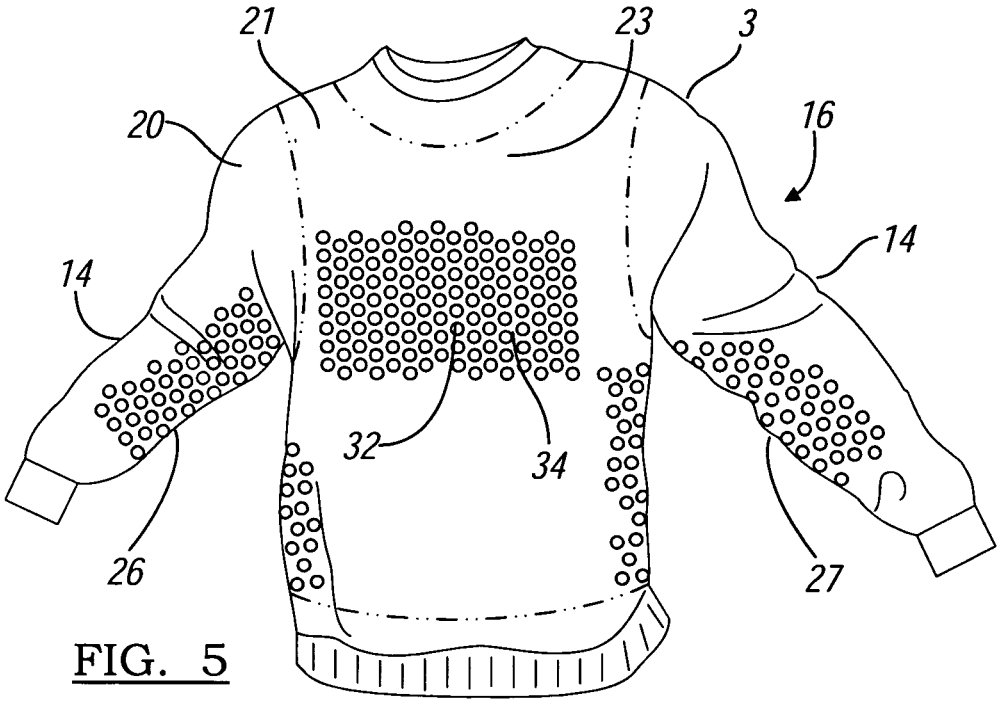
FIG. 5 is a front view of an alternative embodiment of a grip garment according to the principles of the present invention, where the article is a long sleeve shirt having reinforcing material in a a vest-like pattern operatively attached thereto.

Referring now to FIG. 5, a front view of an alternative embodiment of a grip garment 10 according to the principles of the present invention is shown, where the article 12 is a long sleeve shirt 16 having reinforcing material 21 in a a vest-like pattern 23 operatively attached to the flexible material 20. The reinforcing material 21 extend from the lateral grip areas 24, 25 to around the shoulders 3 of the user 1. The reinforcing material 21 may be formed of any suitable material, including, but not limited to, nylon, polyester, various brands of para-aramid synthetic fiber, and polyethylene fiber. The reinforcing material 21 provides additional support, preventing the flexible material 20 from deforming. In the present embodiment, when employing reinforcing material 21 over the flexible material 20, the frictional material 30 would be deposited on an outside surface of the reinforcing material 21 rather than the flexible material 20.

Figure 6:
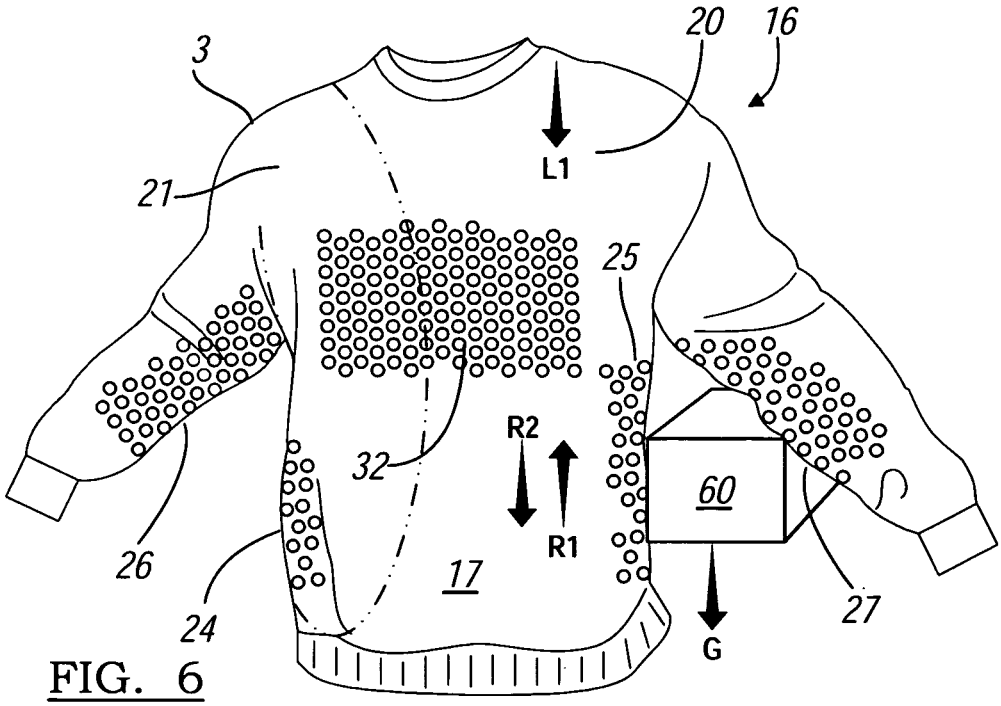
FIG. 6 is a front view of an alternative embodiment of a grip garment according to the principles of the present invention, showing an item carried under the arm of the user, where the article is a long sleeve shirt having reinforcing material operatively attached thereto extending from a right lateral grip area to around the shoulder.

Referring now also to FIG. 6 is a front view of an alternative embodiment of a grip garment 10 according to the principles of the present invention is shown where the article 12 is a long sleeve shirt 16 having a reinforcing material 21 operatively attached to the flexible material 20. In the preferred embodiment, the reinforcing material 21 is applied to the outside surface 22 of the flexible material 20. The reinforcing material 21 extends from the right lateral grip area 24 to around the shoulder 3 of the user 1. The reinforcing material 21 covers the lateral grip area 24 and extends around at least one of the user's shoulders 3 to distribute a load to the shoulder 3. As used herein, "covers the lateral grip area 24" shall mean that the area defining the grip area 24 is covered, not the friction material 30. Accordingly, in the present embodiment, the friction material 30 is applied on the reinforcing material 21. It should be understood that the article 12 of the present invention may be comprised of multiple layers.

Also illustrated is item 60, specifically a box, carried under the arm 19 of the user 1. The item has mass which is acted on by a downward gravitational force "G" in addition to, any force components exerted by the user's arms 19. The friction material 30 that is applied to the lateral grip area 25 of the torso portion 17 provides an upward resistive force "R1" to counter at least in part, the downward gravitational force "G" acting on the box 60. The upward resistive force "R1" works to prevent the box 60 from slipping downward. It should be understood that the grip areas 24-28 also apply reaction forces to oppose slipping in other directions. A reaction force "R2" equal in force and opposite to the resistive force "R1" pulls downward on the article 12. The reaction force "R2" is then supported by the load force "L1" supported by the torso.

Figure 7:
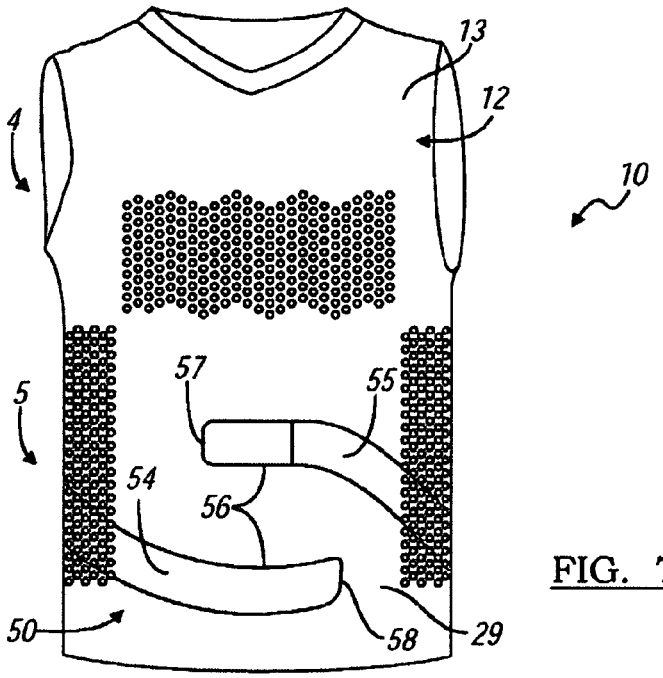
FIG. 7 is a front view of an alternative embodiment of a grip garment according to the principles of the present invention, where the article is a vest having a support belt operatively attached thereto.
Figure 8:
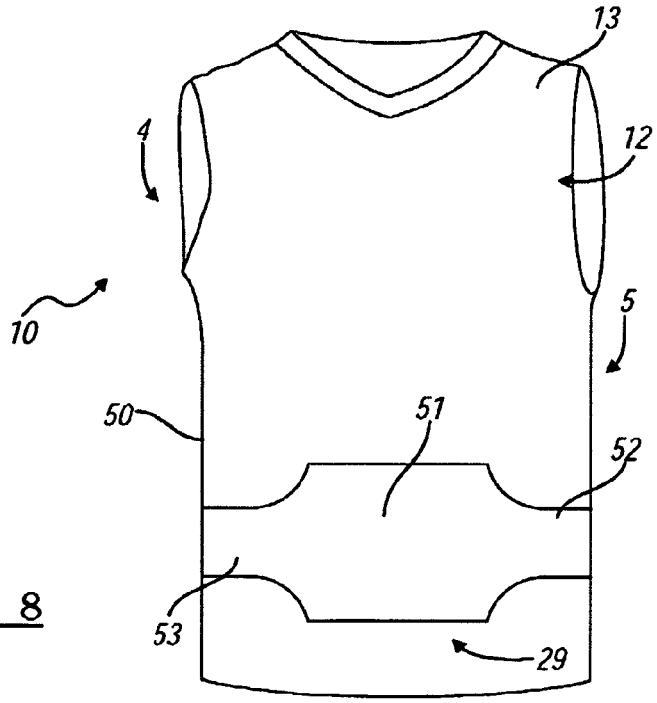
FIG. 8 is a rear view of an alternative embodiment of a grip garment according to the principles of the present invention, where the article is a vest having a support belt operatively attached thereto.

Referring now to FIGS. 7 and 8, front and rear views are shown of an alternative embodiment of a grip garment 10 having a support belt 50 fixedly attached to a lower torso portion 29 of a vest 15. A user's torso 2, which includes an upper torso 4 and lower torso 5, is subject to lifting related injury, specifically the lower torso 4. The support belt 50 provides lower torso 5 support to prevent injury from lifting. The belt 50 includes a relatively wide back portion 51 and two relatively narrow straps 54, 55 extending from first end 52 and second end 53 of the back portion 51. The belt 50 has fastening means 56 for coupling the straps 54, 55 at distal ends 57, 58. In the preferred embodiment, the fastening means 56 is a hook and loop style of fastener, however any suitable substitute known in the art may be used in place of hook and loop fasteners, including various types of belt buckles.

The foregoing discussion discloses and describes the preferred structure and control system for the present invention. However, one skilled in the art will readily recognize from such discussion, and from the accompanying drawings and claims, that various changes, modifications and variations can be made therein without departing from the true spirit and fair scope of the invention as defined in the following claims.

What is claimed is:

1. A grip garment for assisting a user in carrying an item, said garment comprising:

an article of clothing adapted to be worn on the torso of the user and at least partially covering a user's shoulders, said article comprising a flexible material having an inside surface and outside surface, said article having a left side, a right side, a back side and a front side, the right side and left side being generally parallel to the sagittal plane of a torso, at least one lateral grip area, a serratus anterior area and an external oblique area located on the right side and left side of said article, wherein said lateral grip area has an overall length that extends from the serratus anterior area to the external oblique area and said lateral grip area extends from said front side to said back side; and a. friction material applied to said lateral grip area to form a frictional surface extending above said outside surface of said article, said frictional surface adapted to be in contact with an item carried under the arm of a user to resist the relative motion of the item with respect to said grip area.

2. The grip garment of claim 1, wherein said article is selected from the group consisting of a vest, a short sleeve shirt, and a long sleeve shirt.

3. The grip garment of claim 1, wherein said article has a frictional surface on a right lateral grip area and a left lateral grip area.

4. The grip garment of claim 1, further comprising a reinforcing material, operatively attached to said flexible material, said reinforcing material covering said lateral grip area and extending around at least one of the user's shoulders to distribute a load to the shoulder and resist deformation of said flexible material.

5. The grip garment of claim 1, further comprising a support belt fixedly attached to a lower torso area of said article, said belt including a relatively wide back portion and two relatively narrow straps extending from first and second ends of said back portion, said belt having fastening means for coupling said straps at distal ends.

6. The grip garment of claim 1, wherein said grip area has frictional material applied in a spaced pattern.

7. The grip garment of claim 6, wherein said frictional material is applied in a polka of pattern.

8. A grip garment for assisting a user in carrying an item, said garment comprising:

a vest comprising a flexible material having an inside surface and outside surface, said vest having a left side, a right side, a back side and a front side, the sides being generally parallel to the sagittal plane of a torso, a right lateral grip area located on the right side and a left lateral grip area located on the left side, a right serratus anterior area located on the right side and a left serratus anterior area located on the left side, a right external oblique area located on the right side and a left external oblique area located on the left side, wherein each of said lateral grip areas have an overall length that extends from the serratus anterior area to the external oblique area and said lateral grip area extends from said front side to said back side; and a friction material applied to each of said lateral grip areas to form a frictional surface extending above said outside surface of said vest, said frictional surface being in contact with an item carried under the arm of a user to resist the relative motion of the item.

9. The grip garment of claim 8, further comprising selectively detachable right and left arm sections.

10. The grip garment of claim 9, wherein said right arm section has a right brachial grip area and said left arm section has a left brachial grip area, said arm sections have friction material applied to said right brachial grip area and said left brachial grip area to form right and left brachial frictional surfaces for further resisting the relative motion of the item.

11. The grip garment of claim 8, wherein said vest has a friction material applied to an anterior grip area to form an anterior frictional surface; said anterior frictional surface being in contact with an item held against the ventral portion of the torso of a user to resist the relative motion of the item.

12. The grip garment of claim 8, further comprising a support belt fixedly attached to a lower torso area of said vest, said belt including a relatively wide back portion and two relatively narrow straps extending from first and second ends of the back portion, said belt having fastening means for coupling said straps at distal ends.

* * * * *